United States Patent [19]

Fletcher, Jr. et al.

[11] 4,283,477

[45] Aug. 11, 1981

[54] PHOTOTHERMOGRAPHIC MATERIAL AND PROCESS

[75] Inventors: George L. Fletcher, Jr., Pittsford; Richard A. deMauriac, Webster; Stewart H. Merrill, Rochester, all of N.Y.

[73] Assignee: Eastman Kodak Company, Rochester, N.Y.

[21] Appl. No.: 956,828

[22] Filed: Nov. 2, 1978

[51] Int. Cl.[2] ..... G03C 1/52; G03C 1/48; G03C 1/40

[52] U.S. Cl. ..... 430/141; 430/151; 430/169; 430/155; 430/158; 430/160; 430/162; 430/351; 430/353; 430/495; 430/523; 430/545; 430/618; 430/620; 430/611; 430/531

[58] Field of Search ..... 96/67, 74, 76 R, 114.1, 96/75, 48 HD, 49, 50, 77; 430/523, 545, 618, 141, 495, 351, 611, 151, 620, 353, 169, 155, 158, 160, 162

[56] References Cited

U.S. PATENT DOCUMENTS

| | | | |
|---|---|---|---|
| 3,248,219 | 4/1966 | Jacobs | 96/76 R |
| 3,438,776 | 4/1969 | Yudelson | 96/76 R |
| 3,484,238 | 12/1969 | Fox | 96/67 |
| 3,520,691 | 7/1970 | Scheler et al. | 96/75 |
| 3,531,286 | 9/1970 | Renfrew | 96/67 |
| 3,576,632 | 4/1971 | Bornemisza | 96/50 |
| 3,706,557 | 12/1972 | Arond | 96/77 |
| 3,761,270 | 9/1973 | Mauriac et al. | 96/77 |
| 3,785,830 | 1/1974 | Sullivan et al. | 96/114.1 |
| 3,801,321 | 4/1974 | Evans et al. | 96/48 HD |
| 3,871,887 | 3/1975 | Jones | 96/114.1 |
| 3,893,860 | 7/1975 | Sutton et al. | 96/76 R |
| 4,032,344 | 6/1977 | Fletcher et al. | 96/49 |
| 4,032,518 | 6/1977 | Kotlarchik et al. | 96/91 R |
| 4,039,334 | 8/1977 | Ikengue | 96/114.1 |

OTHER PUBLICATIONS

Research Disclosure, Jun. 1977, Item No. 15872 of Fletcher et al.

Research Disclosure, Mar. 1975, Item No. 13107 of Fletcher et al.

Research Disclosure, Sep. 1977, Item No. 16105 of Fletcher et al.

Product Licensing Index, vol. 92, Dec. 1971, Item 9232.

Research Disclosure, Sep. 1977, Item 16160.

Derwent Abstract 32856U-A for SU-355192-S of Lvov Polytechnic.

Research Disclosure, vol. 158, Jun. 1977, Item 15869.

Research Disclosure, vol. 150, Oct. 1976, Item 15026.

Research Disclosure, vol. 157, May 1977, Items 15732, 15733, 15734, 15776.

Derwent Abstract 422764U-AF for SU-361182-S of Lvov POlytechnic.

Derwent Abstract 36825V/20 for German Pat. No. 2,352,348 of Fuji Photo Film Co. Ltd.

Derwent Abstract 23377V/13 for German Pat. No. 2,346,227 of Rhone-Poulenc SA.

*Primary Examiner*—Won H. Louie, Jr.

*Attorney, Agent, or Firm*—Richard E. Knapp

[57] ABSTRACT

In a photothermographic element comprising (A) at least one photosensitive layer comprising a photosensitive component, such as photosensitive silver halide or a diazotype photosensitive material, (B) at least one layer comprising a processing agent for the photosensitive component and (C) a separation polymer between (A) and (B), increased preexposure storage stability is provided by a polysulfonamide as separation polymer (C). After imagewise exposure of the photothermographic element, an image can be developed by merely heating the element to moderately elevated temperatures.

18 Claims, No Drawings

PHOTOTHERMOGRAPHIC MATERIAL AND PROCESS

BACKGROUND OF THE INVENTION

1. Field of the Invention

This invention relates to certain photothermographic elements having increased preexposure storage stability. In one of its aspects it relates to a photothermographic element comprising at least one photosensitive layer comprising a photosensitive component, such as at least one photosensitive silver halide layer, and at least one layer comprising a processing agent for the photosensitive component, with a certain separation polymer between the photosensitive silver halide and the processing agent. In another of its aspects it relates to a process for providing a developed image, such as a silver image and dye image, in a photothermographic element as described. A still further aspect relates to a photothermographic element comprising a diazotype photosensitive material and a separation polymer as described.

2. Description of the State of the Art

It is well known to produce developed images in a photothermographic material. Photothermographic materials are also known as heat developable photographic materials. Photothermographic materials after imagewise exposure are heated to moderately elevated temperatures in the absence of processing solutions or baths to provide a developed image. The heat development can produce a developed image, such as a developed silver image.

In some photothermographic elements it has been useful to have a separation layer between certain layers of the element. The separation layer as used herein is intended to refer to a layer which separates the photosensitive layer from other layers of the element such as a layer containing a processing agent. The separation layer in some instances has provided increased preprocessing stability for the photothermographic element. This is illustrated, for example, in U.S. Pat. No. 3,893,860 of Sutton and Stapelfeldt, issued July 8, 1975 wherein certain acrylamide polymers are described as useful in certain layers of a photothermographic element comprising certain silver salts of heterocyclic thione compounds and photosensitive silver halide. While the acrylamide polymers described provide a degree of improvement in such a photothermographic element, a need has continued to exist to provide further increased stability of a photothermographic element prior to imagewise exposure of the element. The selection of a useful material for such separation layers encounters several problems. In many cases the polymer selected does not satisfy one or more of the characteristics that are desirable, such as (1) providing sufficient resistance to surface bubbling in a photothermographic material upon processing, (2) not significantly adversely affecting sensitometric properties of the photothermographic material, (3) being sufficiently transparent for desired viewing of an image, (4) having sufficient resistance to decomposition at processing temperatures, and (5) providing a sufficient degree of permeability to permit processing materials to diffuse through the element at the desired time and desired rate at processing temperature.

Proposals have been made for separation layers in silver photothermographic elements, as illustrated by the photothermographic element described in U.S. Pat. No. 3,893,860 and the diazotype heat processable materials described in U.S. Pat. No. 3,520,691 of Scheler et al, issued July 14, 1970. Separation layers have also been proposed in processing webs which can be laminated to photothermographic elements. These are described, for example, in U.S. Pat. No. 3,248,219 of Jacobs, issued Apr. 26, 1966 and U.S. Pat. No. 3,576,632 of Bornemisza, issued Apr. 27, 1971. Polymers proposed for separation of the photosensitive component and a processing agent in such materials are not entirely satisfactory for photothermographic silver or diazotype elements because they do not satisfactorily answer one or more of the described problems.

It has been desirable to provide a photothermographic element, especially a photosensitive silver halide photothermographic element and a diazotype photothermographic element, which demonstrates increased stability under storage conditions prior to imagewise exposure and improved control of rate of development upon processing at processing temperatures.

SUMMARY OF THE INVENTION

It has been found that the described improvements are provided according to the invention in a photothermographic element comprising (A) at least one photosensitive layer comprising a photosensitive component, such as photosensitive silver halide or a photosensitive diazotype material, (B) at least one layer comprising a processing agent for the photosensitive component and (C) a particular separation polymer, such as a separation polymer in the form of a layer, between (A) and (B). The separation polymer (C) is a polysulfonamide which has the property of producing increased preexposure storage stability for the element.

A developed image in such a photothermographic material can be produced after imagewise exposure by merely heating the element to moderately elevated temperatures.

For example, a photothermographic element according to the invention can comprise (A) a layer comprising, (a) in a binder, (b) a dye-forming coupler, (c) a reducing agent which in its oxidized form reacts with the coupler to produce a dye, and (B) a layer comprising, (d) in a binder, (e) photosensitive silver halide and (f) an organic silver salt oxidizing agent which, with said reducing agent, is an oxidation-reduction image-forming combination, and (C) an overcoat layer, wherein improved preexposure storage stability is provided by a polysulfonamide as the binder in (A). The polysulfonamide in such an embodiment of the invention serves both as a separation component between the layers and also as a binder for the processing components described.

DETAILED DESCRIPTION OF THE INVENTION

A variety of polysulfonamides, typically sulfonamides which are copolymers, can be useful in photothermographic materials as described. The polysulfonamides are preferably copolymers which do not adversely affect the physical or chemical properties desired at the processing temperatures required for the described photothermographic elements. This is intended to mean herein that the described polymers, preferably copolymers, do not significantly adversely discolor, decompose, crystallize or flow. Also, the polymers do not significantly adversely affect sensitometric properties of the photothermographic element as the result of heating the photothermographic element during processing. The polysulfonamides also are preferably those which do not adversely smear or distort the desired image at processing temperatures. They also do not cause significant adverse opacification of the photothermographic material. Typically, the polysulfonamides have an average molecular weight that is within the range of about 3,000 to about 500,000, preferably 5,000 to about 100,000. The polysulfonamides are film forming and have glass transition temperatures which are at least 60° C. and preferably above about 120° C. Combinations of polysulfonamides are often useful in the photothermographic materials as described. Especially useful polysulfonamides are typically transparent and colorless. It is highly desirable, if the polysulfonamide is not completely transparent, that it be at least transparent to the wavelength of radiation useful for providing a latent image in the photothermographic element.

The term "separation polymer" as used herein is intended to refer to the described polysulfonamides. These polysulfonamides physically and chemically separate the processing agent from the photosensitive component in a photothermographic element according to the invention. This separation enables desired increased storage stability of the element before imagewise exposure results. The separation polymer can be, for instance, in the form of a separation layer between a layer containing the photosensitive component and an adjacent layer containing the processing agent. Alternatively, the separation polymer can be present in a layer containing a processing agent contiguous to a layer containing the photosensitive component. The separation polymer is in a physical location and form in the photothermographic element which effectively separates the desired components at temperatures below processing temperature. But, the separation polymer must enable desired interaction of the photosensitive component and the processing agent at processing temperature.

Useful polysulfonamides have inherent viscosities, measured at a concentration of 0.025 grams per deciliter in dimethyl formamide at 25° C., ranging from 0.4 to 1.3 and preferably from 0.6 to 0.8.

Selection of an optimum polysulfonamide or combination of polysulfonamides will depend upon such factors as the particular photothermographic element, desired image, processing conditions, particular processing agents in the photothermographic element, particular photosensitive component, layer thicknesses and the like. Typically useful polysulfonamides have in the backbone of the polymer or pendant therefrom the moiety $—SO_2N<$. Especially useful classes of polysulfonamides contain toluene-2,4-disulfonamide units and contain equivalent sulfonamide units. The polysulfonamides can be copolymers, homopolymers or physical mixtures of these polymers. Whether the polymer is an addition polymer or a condensation polymer, a minimum portion of the polymer should be recurring sulfonamide groups of the structure $—SO_2N<$.

One example of a useful class of polysulfonamides is represented by the polysulfonamides have recurring units represented by the structure:

$$\left[X\right]\left[Y\right] \qquad (1)$$

wherein X has the structure:

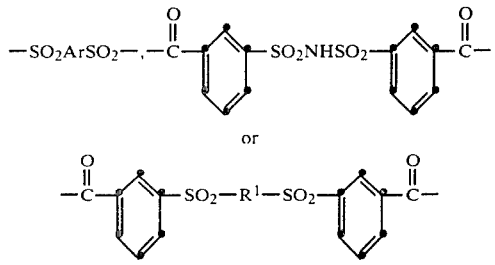

wherein Ar is an arylene group, such as an arylene group containing 6 to 12 carbon atoms, for example, phenylene, typically meta-phenylene, 2,4-tolylene, 4,4'-biphenylene and 2,7-naphthylene; and, $R^1$ is a heterocyclic group, such as a 5- or 6-membered heterocyclic group containing the nitrogen, oxygen and carbon atoms necessary to complete the heterocyclic group, for example, 1,4-piperazinylene and 2,5-dimethyl-1,4-piperazinylene or alkylene, such as alkylene containing 1 to 10 carbon atoms, for example, methylene, ethylene, propylene, butylene, phenylethylene, dimethylpropylene and the like;

Y is represented by the structure —G—Z—G, wherein G is —C—O—, —O, or $(NH)_m$ and is selected to insure the presence of recurring $—SO_2N(H)_m—$ groups in the polymer backbone; m is 0 or 1; and, Z is an aliphatic or aromatic organic residue of the diol or a diamine when m is 1, formed by removal of the 2-hydroxy, amino or hydrazino groups on the respective organic diol, diamine or dihydrazide compound, as exemplified by ethylene, cyclohexylene dimethylene, tetramethylene, hexamethylene, ethylenebis(oxycarbonyl para-phenylene) 2,2-isopropylidenebis(para-phenyleneoxyethyleneoxycarbonyl-para-phenylene) and the like.

Other useful polysulfonamides are those comprising recurring units which conform to structure (II):

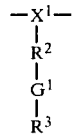

(II)

wherein $X^1$ is the backbone of a polymer including, for example, an addition polymer backbone;

$G^1$ is a sulfonamido group

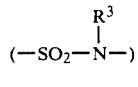

appended to $R^2$ through either the sulfur or nitrogen atom;

$R^2$ is a linking group between the sulfonamido group, $G^1$, and the polymer backbone, $X^1$, such as the atoms necessary to complete an aromatic ring in the polymer backbone:

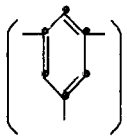

or an aromatic group, e.g., phenylene, a carbonyliminophenylene group:

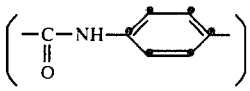

and the like; and $R^3$ is a hydrogen atom, or aliphatic or aromatic group, for example, methyl, phenyl, tolyl and the like.

Vinyl addition polymers within the described structures can also contain recurring units derived from vinyl monomers such as styrene, 4-methylstyrene and the like, and especially acrylic monomers such as acrylic esters, such as methyl methacrylate, ethyl acrylate, and the like.

A particularly useful class of sulfonamide polymers is that in which the polymer has at least one repeating unit selected from the group consisting of:

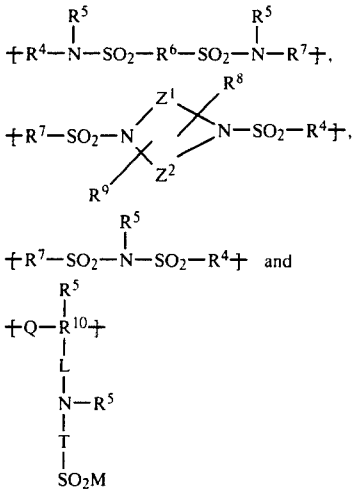

(III)

(IV)

(V)

(VI)

wherein:

$R^4$ is a member selected from the group consisting of:

(i) a substituted or unsubstituted saturated carbocyclic containing from 5 to 10 carbon atoms in the ring, such as an alicyclenealkylene or alicyclenebis-(oxyalkylene) radicals, for example, cycloheptylenemethylene, cyclohexylenedimethylene and the like;

(ii) a substituted or unsubstituted alkylene radical containing from 1 to 10 carbon atoms, for example, methylene, ethylene, propylene, butylene, phenylethylene, dimethylpropylene and the like;

(iii) an oxycarbonylphenylene radical; and (iv) the —NH— radical;

$R^6$ is a saturated carbocyclic or aromatic ring such as a substituted or unsubstituted arylene radical containing from 5 to 10 carbon atoms, for example, phenylene, naphthylene and the like; the substituents on the aromatic carbons being, for example, any one or two of an alkyl radical having from 1 to 4 carbon atoms; a halide; a phenyl; an acyl or alkoxy radical having from 1 to 4 carbon atoms in the alkyl portion, such as acetyl, butyryl, methoxy, ethoxy and the like; and an alkylthio radical, for example, ethylthio, methylthio, butylthio and the like;

$R^7$ is a member selected from the group consisting of:

(i) an alkyleneoxycarbonylphenylene radical having from 1 to 5 carbon atoms in the alkylene function, for example, ethyleneoxycarbonylphenylene and the like;

(ii) a carbonylimino radical;

(iii) a nitrogen-carbon bond when $R^4$ is other than an oxycarbonylphenylene or the imino radical —NH—; and (iv) an $\alpha$-iminocarbonyl-$\omega$-carbonylalkylene radical when $R^4$ is an imino radical and $R^4$ and $R^7$ are each bonded to a nitrogen atom, for example, $\alpha$-iminocarbonyl-$\beta$-carbonylalkylene, $\alpha$-iminocarbonyl-$\gamma$-carbonylalkylene and the like;

$Z^1$ and $Z^2$ are the same or different, and are each the number of atoms necessary to complete a heterocyclic group, such as a 5- or 6-member heterocyclic group, for example, methylene, propylene and the like;

$R^8$ and $R^9$ are the same or different and can be hydrogen, or methyl joined to one of the carbon atoms to form with $Z^1$ and $Z^2$ 2,5-dimethylpiperazinylene and the like;

$R^5$ is methyl or hydrogen;

L is a member selected from the group consisting of a carbon-nitrogen bond, a phenylene group linked to the repeating unit in the ortho or para positions, and carbonyl;

M is amino ($—NH_2$), alkyl containing 1 to 10 carbon atoms, such as methyl, ethyl, propyl, butyl and the like, or aryl containing 6 to 10 carbon atoms, including unsubstituted aryl or methyl substituted aryl, such as phenyl, naphthyl and methyl substituted phenyl;

Q is alkylene containing 2 to 5 carbon atoms, such as ethylene, propylene and butylene, when $R^{10}$ is isophthalate or terephthalate, and otherwise is a chemical bond; and T is a substituted or unsubstituted saturated carbocyclic or aromatic ring containing 5 to 10 carbon atoms in the ring, such as alicylenedialkylene or alicyclenebis-(oxyalkylene), for example, cycloheptylenemethylene and cyclohexylenedimethylene, the aromatic ring being linked to the repeating unit in the ortho or para positions; substituted or unsubstituted alkylene containing 1 to 10 carbon atoms, for example, methylene, ethylene, propylene, butylene, phenylethylene, and dimethylpropylene; or a nitrogen to sulfur bond when M is other than amino.

Examples of useful polysulfonamides include:

poly(cyclohexylenedimethylene-toluene-2,4-disulfonamide), poly(hexamethylene-1,3-benzenedisulfonamide), poly(hexamethylene-toluene-2,4-disulfonamide), poly[ethylene toluene-2,4-bis(p-sulfonamidobenzoate)], poly(tetramethylene-5-methylsulfonamidoisophthalate), poly[N-(4vinylphenyl)methanesulfonamide], poly(N-methacryloyl-p-toluenesulfonamide), poly(tetramethylenedicarbonyl-1-toluene-2,4-disulfonhydrazide), poly(1,4-cyclohexylenedimethylene-1,4-cyclohexanedisulfonamide), poly(trimethylene-1-methyl-2,4-benzenedisulfonamide),
poly(1,4-cycloheptylenemethylene-1-methoxy-3,6-naphthalenedisulfonamide),
poly[trimethylene methylthiobenzene-2,4-bis-(p-N-methylsulfonamidobenzoate)],
poly(2-acrylamidocyclohexane-N-hexylsulfonamide),
poly(ethylene 2-methylhexahydropyrimidinylenebis-sulfonyl-m-benzoate),
poly(ethylene-co-1,4-cyclohexylenedimethylenetoluene-2,4-disulfonamide),
poly(ethylene-co-hexamethylene-toluene-2,4-disulfonamide),
poly(cyclohexylenedimethylene-toluene-2,4-disulfonamide),
poly[styrene-co-N-(4-vinylphenyl)methanesulfonamide)],
poly(N-methacryloyl-p-toluenesulfonamide),
poly(N-methacryloylsulfanilamide-co-methyl methacrylate),
poly(tetramethylenedicarbonyl-1-toluene-2,4-disulfonylhydrazide),
poly[ethylene 3,3'-(iminodisulfonyl)dibenzoate-co-terephthalate],
poly[neopentyl-co-4,4'-isopropylidene-bis(phenoxyethylene)toluene-2,4-bis(p-sulfonamidobenzoate)-co-terephthalate],
poly[ethylene 2,5-dimethyl-1,4-piperazinylenebis(sulfonyl-m-benzoate)], and
poly(ethylene-co-hexamethylene-toluene-2,4-disulfonamide).

Examples of other compounds that are polysulfonamides and their preparation are described in U.S. Pat. No. 4,032,344 of G. L. Fletcher, S. H. Merrill and C. Kotlarchik, issued June 28, 1977, the disclosure of which is incorporated herein by reference.

The preparation of the described polysulfonamides can be carried out by means of procedures known in the art. Such procedures are described, for example, in U.S. Pat. No. 4,032,344, the description of which is incorporated herein by reference.

Other useful polysulfonamides are described in, for example, *Research Disclosure,* June 1977, Item 15872, of G. L. Fletcher, D. H. Wadsworth and J. E. Jones; *Research Disclosure,* March 1975, Item 13107, of G. L. Fletcher, S. H. Merrill and C. Kotlarchik; and *Research Disclosure,* September 1977, Item 16105, of G. L. Fletcher and J. Dedinas, the descriptions of which are incorporated herein by reference.

Especially useful polysulfonamides are represented by the structure:

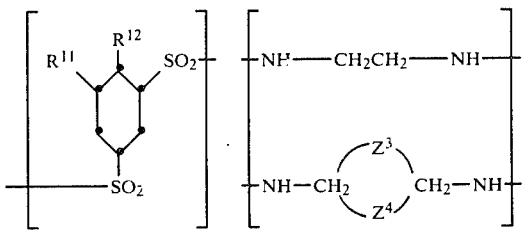

wherein $R^{11}$ and $R^{12}$ are individually alkyl containing 1 to 3 carbon atoms such as methyl, ethyl and propyl, halogen, such as chlorine; and $Z^3$ and $Z^4$ represent the carbon atoms necessary to complete an unsaturated or saturated carbocyclic ring, such as the carbon atoms necessary to complete a 6-member carbocyclic ring.

An especially useful polysulfonamide is represented by the structure:

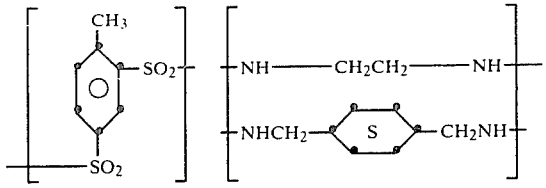

The described preferred polysulfonamides, which are copolymers, can be prepared by polycondensing in solution the appropriate aromatic and alkyldiamines and disulfonylchloride. An example of such a preparation is as follows: A flask equipped with a suitable mixing means, reflex condensor, and dropping funnel is charged with diamine, calcium hydroxide and tetrahydrofuran (THF). The mixture is heated to boiling on a steam bath after which the steam bath is removed and a solution of the disulfonylchloride in THF is added to the vigorously stirred mixtures rapidly as the condensor accomodates the exothermic reaction (about 203 minutes). The thick suspension resulting is stirred and heated on a steam bath for an additional hour, and then cooled to room temperature (about 21° C.). Acetone is added and after stirring for 30 minutes the resulting suspension is filtered under vacuum through appropriate filter paper. The resulting clear solution is precipitated into 10 times its volume of water with vigorous stirring and then soaked in fresh water over night. The resulting fibrous polymer is air dried for 24 hours and then vacuum dried at 45° C. to constant weight.

The described polysulfonamides can be used in a range of concentrations in a layer of a photothermographic element as described. Selection of an optimum concentration of polysulfonamide will depend upon such factors as the particular photothermographic element, desired image, processing conditions, particular photosensitive component, processing agents in the photothermographic element, and the like. Typically, the concentration of polysulfonamide, as described, is within the range of about 40% to about 90%, preferably 70% to about 90% by weight. When the polysulfonamide is used as a separation layer, the concentration of polysulfonamide is within the range of about 80 to about 90% by weight.

The polysulfonamide as described is useful in a variety of photothermographic elements. The exact mechanism by which the polysulfonamide produces the described advantages, especially the increased preexposure storage stability, is not fully understood. However, it is believed that the polysulfonamide in some way moderates the chemical reaction rate of reactive molecules in the photothermographic element at room temperature. This is evidenced by the fact that at temperatures substantially above room temperature very fast reaction rates can be observed in the photothermographic element while at ambient temperature (about 20° to 25° C.) extremely slow reaction rates are observed in the photothermographic element. The differences in reaction rates between the described processing temperature and ambient temperature (about 20°-25° C.) may be as high as 8 million times. It is believed that this difference in reaction rate produces the desired stability of the photothermographic element to ambient storage conditions and at the same time enables the use of reduced processing times to produce a desired image.

The term "processing agent" as used herein is intended to refer to any compound in a photothermographic element which reacts in some way at processing temperature with one or more components of the photothermographic element to help produce a desired image. In a silver halide photothermographic element, for instance, useful processing agents including developing agents, developing agent precursors, base-release agents, post-processing image stabilizers and stabilizer precursors, antifoggants, organic silver salt oxidizing agents, dye-forming coupler, toning agents, and chemical and spectral sensitizers. In a diazotype photothermographic element, for instance, useful processing agents include dye-forming compounds, protective acids, antioxidants, development conditioners and contrast conditioners.

The described processing agents of the photothermographic materials according to the invention can be in any suitable location in the photothermographic element which produces the desired image at processing temperatures. It can be useful in some cases, for example, to include certain percentages of the described reducing agents, image stabilizer or image stabilizer precursors and other addenda in a protective layer over the photothermographic element. In some cases it can be useful to include certain of the processing components in a polysulfonamide containing layer.

An example of a photothermographic element in which the described polysulfonamides are useful is a photothermographic element for producing a dye enhanced silver image. Such a photothermographic element for producing a dye enhanced silver image can comprise, in a binder, (a) photosensitive silver halide in reactive association with (b) an image-forming combination comprising (i) an organic silver salt oxidizing agent with (ii) an organic reducing agent, and (c) a dye-forming coupler that forms a dye with the oxidized form of the reducing agent at processing temperatures. An example of such a photothermographic element for producing a dye enhanced silver image is described in copending U.S. application Ser. No. 892,593 of Willis, Knight and Pupo, filed Apr. 3, 1978, now abandoned. Another example of a useful photothermographic element is one comprising photosensitive silver halide in association with a silver salt of a certain heterocyclic thione compound and an organic reducing agent. Such a photothermographic element is described in, for example, U.S. Pat. No. 3,785,830 of Sullivan, Cole and Humphlett, issued Jan. 15, 1974. Another example is a photothermographic element comprising photosensitive silver halide in reactive association with an oxidation-reduction image-forming combination comprising an organic silver salt oxidizing agent, such as silver behenate, with a suitable reducing agent, such as a sulfonamidophenol reducing agent, in a suitable binder. Such a photothermographic element is described in, for example, U.S. Pat. No. 3,801,321 of Evans and McLaen, issued Apr. 2, 1974 as well as U.S. Pat. No. 3,871,887 of Jones, issued Mar. 18, 1975. The disclosures of these patents are incorporated herein by reference.

One embodiment of the invention is a photothermographic element comprising a support having thereon (A) a first layer comprising (a) photosensitive silver halide in reactive association with (b) an organic silver salt oxidizing agent, in (c) a gelatino binder, and (B), contiguous to (A), a second layer comprising (d) a diffusible, organic reducing agent for the organic silver salt, (e) a diffusible, dye-forming coupler that forms a dye with the oxidized form of the reducing agent in (f) a polymeric binder consisting essentially of a polysulfonamide, as described. The polysulfonamide has the properties of (1) being permeable to the oxidized form of the reducing agent and (2) producing increased pre-exposure storage stability for the photothermographic element.

In some cases it can be useful to provide an antistrike layer in the photothermographic element of the invention. The term "antistrike layer" as used herein is intended to refer to a layer which prevents undesired penetration of solvent into or through the layer. When one coating is applied over a second dried coating, the solvent of the upper coating often penetrates the layer beneath, carrying with it any soluble material. When the top coating is subsequently dried, the penetrating solvent migrates out of both layers carrying with it (and mixing) soluble components of layers. This is often undesirable in photothermographic elements of the invention. For this reason, among others, it is often desirable to have an antistrike layer present to prevent the undesired penetration of solvents.

A further embodiment of the invention is a photothermographic element comprising a support having thereon, in sequence, (A) a first layer comprising (a) a polysulfonamide binder, as described, and (b) a silver halide stabilizing concentration of a heterocyclic thione silver halide stabilizing agent, and, contiguous to (A), (B) a second layer consisting essentially of (c) a polymeric antistrike composition, and, contiguous to (B), (C) a third layer comprising (d) photosensitive silver halide in reactive association with (e) an oxidation-reduction image-forming combination comprising (i) a silver salt of a long-chain fatty acid, with (ii) a reducing agent in (f) a binder, such as a poly(vinyl butyral) binder.

The term "material" as used herein, such as in photothermographic material, is intended to include elements and compositions. For instance, the use of "photothermographic material" is intended to refer to photothermographic element and photothermographic composition.

The photothermographic materials according to the invention comprise a photosensitive component, such as photosensitive silver halide. Photosensitive silver halide is especially useful because it has a high degree of photosensitivity compared to other photosensitive components. A typical concentration of photosensitive silver halide in a photothermographic material according to the invention is within the range of about 0.01 to about 1.0 mole of photosensitive silver halide per mole of the described organic silver salt oxidizing agent in the photothermographic material. Other photosensitive materials can be useful in combination with the described photosensitive silver halide, if desired. Preferred photosensitive silver halides are silver chloride, silver bromide, silver bromoiodide, silver chlorobromoiodide or mixtures thereof. For purposes of the invention, silver iodide is also considered to be a photosensitive silver halide. A wide range of grain size of photosensitive silver halide from very coarse-grain to very fine-grain silver halide is useful. Selection of an optimum reducing agent or other processing agent will be influenced by the silver halide grain size and other properties of the particular silver halide grains.

The photosensitive silver halide can be prepared by any of the procedures known in the photographic art. Useful procedures and forms of photosensitive silver halide for purposes of the invention are described in, for example, the *Product Licensing Index,* Volume 92, December 1971, Publication 9232 on page 107, published by Industrial Opportunities Limited, Homewell, Havant Hampshire, P09 1EF, UK. The photographic silver halide, as described, can be washed or unwashed, can be chemically sensitized by means of chemical sensitization procedures and materials known in the art, can be protected against the production of fog and stabilized against loss of sensitivity during keeping as known in the photographic art.

A variety of organic silver salt oxidizing agents can be useful in the described photothermographic materials according to the invention. One class of useful organic silver salt oxidizing agents is silver salts of 1,2,4-mercaptotriazole derivatives. Such organic silver salt oxidizing agents are described in, for example, *Research Disclosure,* Volume 158, June 1977, Item 15869, of Knight, deMauriac and Graham, which is incorporated herein by reference.

Another useful class of organic silver salt oxidizing agents is represented by complexes of silver with a nitrogen acid, such as a nitrogen acid selected from the group consisting of imidazole, pyrazole, urazole, 1,2,4-triazole and 1H-tetrazole nitrogen acids or combinations of these acids. These silver salts of nitrogen acids are described in, for example, *Research Disclosure,* Volume 150, October 1976, Item 15026, of deMauriac, the disclosure of which is incorporated herein by reference. Examples of useful silver salts of nitrogen acids are the silver salts of 1H-tetrazole; dodecyltetrazole; 5-n-butyl-1H-tetrazole; 1,2,4-triazole; urazole, pyrazole; imidazole; and benzimidazole.

A further class of useful organic silver salt oxidizing agents includes silver salts of certain heterocyclic thione compounds. Useful silver salts of the described thione compounds include, for example, the silver salts of 3-carboxymethyl-4-methyl-4-thiazoline-2-thione; 3-(2-carboxyethyl)-4-methyl-4-thiazoline-2-thione; 3-(2-carboxyethyl)benzothiazoline-2-thione; 3-(2-carboxyethyl)-1-methylimidazoline-2-thione and the like. Useful silver salts of the described thione compounds are described in, for example, U.S. Pat. No. 3,893,860 of Sutton and Stapelfeldt, the description of which is incorporated herein by reference.

Selection of an optimum organic silver salt oxidizing agent or silver salt oxidizing agent combination will depend upon such factors as the desired image, particular silver halide, processing conditions, particular reducing agent and the like.

The terms "salt" and "complex" as used herein are intended to include any type of bonding or complexing mechanism which enables the resulting material to provide desired imaging properties in the desired photothermographic materials according to the invention. In some instances, the exact bonding of the described organic silver salt is not fully understood. The terms "salt" and "complex" are intended to include neutral complexes and non-neutral complexes.

The described organic silver salt oxidizing agent may be used in a range of concentrations in the described photothermographic materials. Selection of an optimum concentration of organic silver salt oxidizing agent will depend upon such factors as the particular reducing agent, the particular photosensitive silver halide, processing conditions, and the like.

The described photothermographic materials can comprise a variety of reducing agents, especially organic reducing agents which are typically photographic silver halide developing agents. Combinations of organic reducing agents can be useful. Reducing agents which are useful include, for example, such silver halide developing agents as polyhydroxybenzenes, such as hydroquinone, alkyl-substituted hydroquinones; catechol and pyrogallol developing agents; chloro-substituted hydroquinone; alkoxy-substituted hydroquinone; aminophenol reducing agents such as 2,4-diaminophenols and methylaminophenols; ascorbic acid developing agents, such as ascorbic acid, ascorbic acid ketals and ascorbic acid derivatives; hydroxylamine reducing agents; 3-pyrazolidone reducing agents such as 1-phenyl-3-pyrazolidone and 4-methyl-4-hydroxymethyl-1-phenyl-3-pyrazolidone; reductone reducing agents; gallic acid ester reducing agents such as methyl gallate; sulfonamidophenol reducing agents; phenylenediamine silver halide developing agents and the like. In the case of photothermographic materials containing a dye-forming coupler, the reducing agent will be selected from those primary aromatic amines which in their oxidized form react with the coupler to form a suitable dye. Such primary aromatic amine reducing agents include, for example, 2-methyl-4-(N-ethyl-N-hydroxyethyl)-aminoaniline hydrogen sulfate and 4-amino-2-methoxy-N,N,5-trimethylaniline sulfate.

Selection of an optimum reducing agent or reducing agent combination will depend upon such factors as the desired image, particular photosensitive silver halide, particular dye-forming coupler if a coupler is present in the photothermographic material, particular organic silver salt oxidizing agent, processing conditions and the like.

The term "reducing agent" herein is intended to include compounds which are reducing agents and reducing agent precursors in the described photothermographic materials. That is, those compounds are intended to be included which are not reducing agents in the photothermographic material until a condition occurs such as heating of the photothermographic material.

In some photothermographic materials, according to the invention, it is highly desirable at processing temperature that the described separation polymer be permeable to the processing agent in order to provide the desired processing. Selection of a suitable processing agent will be influenced by the degree of permeability of the described separation polymer. Selection will also be influenced by the activation energy of diffusion. The term "activation energy of diffusion" as used herein is intended to refer to the relative rate at which diffusion of the processing agent takes place at different temperatures. Two convenient points of temperature reference are used for purposes of determining the relative rate of which diffusion takes place. One point is at ambient temperature (about 20° C.) and the other point is at elevated temperature (a temperature of about 120° C. to about 130° C.). If the difference in diffusion of the processing agent at these temperature points is equal to or greater than about $8\times10^6$, then the diffusion rate is described as high. If the difference in diffusion is below this value, then the diffusion rate is described as low. The differential rate of diffusion can also be expressed in units of kilocalories per mole. The described diffusion rate is especially applicable to reducing agents.

A useful concentration of the described reducing agent in a photothermographic material according to the invention is typically within the range of about 0.5 to about 5.0 moles of the reducing agent per mole of the described Ag salt. The optimum concentration of reducing agent can be determined based upon such factors as the desired image, processing conditions, particular photosensitive component, particular organic silver salt oxidizing agents, and the like.

In the case of photothermographic materials that contain dye-forming couplers, a variety of such dye-forming couplers can be useful. Optimum results are obtained when the particular dye-forming coupler does not adversely interact with other components of the photothermographic material until the oxidized form of the described reducing agent which reacts with the coupler is produced at processing temperature. It is necessary that the dye-forming coupler be in a location with respect to the oxidized form of the described reducing agent upon processing to enable the formation of the desired dye upon heating the photothermographic material. One class of useful dye-forming couplers comprises resorcinol dye-forming couplers. Monosubstituted resorcinol dye-forming couplers with a substituent in the two position are particularly useful. Such resorcinol couplers are described in, for example, copending U.S. application Ser. No. 892,593 of Willis, Knight and Pupo, filed Apr. 3, 1978, now abandoned. Other useful dye-forming couplers are described, for example, in U.S. Pat. No. 3,531,286 of Renfrew, issued Sept. 29, 1970 and U.S. Pat. No. 3,761,270 of deMauriac and Landholm, issued Sept. 25, 1973. Examples of useful dye-forming couplers include 2′,6′-dihydroxytrifluoroacetanilide and 2,6-dihydroxyacetanilide.

The dye-forming coupler can be used in a range of concentrations in the described photothermographic element. Selection of an optimum concentration will depend upon such factors as the location of the dye-forming coupler in the photothermographic element, the particular reducing agent, particular processing conditions, desired image and the like. Typically, the concentration of dye-forming coupler is within the range of about 0.1 to about 3 moles of dye-forming coupler per mole of Ag salt in the photothermographic element.

The photothermographic materials according to the invention can contain a variety of colloids and polymers, alone or in combination, as vehicles, binding agents and in various layers. If the colloid or polymer is used in combination with the described polysulfonamide, it is necessary that the colloid or polymer not adversely affect the desired permeability and other properties of the sulfonamide polymer. Useful colloids and polymers, as described, are preferably hydrophilic materials although some hydrophobic materials can be useful. The colloids and polymers are transparent or translucent and include both naturally-occurring substances such as proteins, for example, gelatin, gelatin derivatives, cellulose derivatives, polysaccharides, such as dextran and the like; and synthetic polymeric substances such as water soluble polyvinyl compounds like poly(vinyl pyrrolidone), acrylamide polymers and the like. Other synthetic polymeric compounds which can be useful include dispersed vinyl compounds, such as in latex form, and particularly those which increase dimensional stability of photographic materials. Effective polymers include high molecular weight materials, especially polymers and resins which are compatible with the described organic silver salt oxidizing agent and other components of the photothermographic material. Combinations of the described colloids and polymers, including the described polysulfonamides, can also be useful.

The photothermographic materials according to the invention can contain an image toner in order to produce a more nearly neutral appearing or black tone image upon processing. Combinations of image toners can also be useful. The optimum toning agent or toning agent combination will depend upon such factors as the particular photosensitive silver halide, the desired image, particular processing conditions and the like. In the case of an organic silver salt oxidizing agent which is a silver salt of a nitrogen acid useful toning agents include 5-amino-1,3,4-thiadiazole-2-thiol; 3-mercapto-1,2,4-triazole and bis(dimethylcarbamyl)disulfide.

The toning agent can be used in a range of concentrations in a photothermographic material according to the invention. The optimum concentration of toning agent or toning agent combination will depend upon the described factors, such as particular photosensitive silver halide, desired image, processing conditions and the like. A typically useful concentration of toning agent is within the range of about 0.01 to about 0.1 mole of toning agent per mole of organic silver salt oxidizing agent in the photothermographic material.

It is often desirable to include a melt-forming compound in the photothermographic material according to the invention. The melt-forming compound often provides an improved developed image. The term "melt-forming compound" as employed herein is intended to mean a compound which upon heating to the described processing temperature produces an improved reaction medium, typically a melt medium, within which the described image-forming combination and photosensitive component can produce better image development. The exact nature of the reaction medium in the photothermographic material at processing temperatures is not fully understood; however, it is believed that at the reaction temperatures a melt occurs which permits the reaction components to better interact and diffuse into contiguous layers of the photothermographic element. Useful melt-forming compounds are typically separate components from the image-forming combination, although the image-forming combination and other addenda in the photothermographic material can enter into the melt formation. Typically useful meltforming compounds are amides, imides, cyclic ureas and triazoles which are compatible with the other components of the photothermographic materials. Useful melt-forming compounds can be selected from those described in, for example, U.S. Pat. No. 3,438,776 of Yudelson, issued Apr. 15, 1969. Examples of useful melt-forming compounds include acetamide, 1,3-dimethylurea, 2-pyrrolidone, and formamide.

The melt-forming compound can be used in a range of concentrations in the described photothermographic materials. Typically the concentration of melt-forming compound is within the range of about 0.5 to about 2 parts by weight of melt-forming compound per gram of organic silver salt oxidizing agent in the photothermographic element. The optimum concentration of melt-forming compound will depend upon the described factors, such as the particular photothermographic material, desired image, processing conditions, particular binders and the like.

The photothermographic materials according to the invention can contain other addenda, such as development modifiers that function as speed-increasing compounds, hardeners, plasticizers and lubricants, coating aids, brighteners, absorbing and filter dyes, antistatic materials or layers, antifoggants, and the like. These are described in, for example, the *Product Licensing Index*, Volume 92, December 1971, Publication 9232.

Spectral sensitizing dyes can be useful in the described photothermographic materials to confer additional sensitivity to the photothermographic materials. Useful sensitizing dyes are described in, for example, the *Product Licensing Index*, Volume 92, December 1971, Publication 9232, pages 107–110, paragraph XV. Especially useful spectral sensitizing dyes can be selected from anionic cyanine dyes, anionic merocyanine dyes and combinations of these dyes.

The photothermographic materials that contain photosensitive silver halide with an organic silver salt oxidizing agent and a reducing agent typically have a pH which is on the acid side of neutral, that is a pH of less than 7. In such photothermographic materials a typically useful pH is within the range of about 2 to about 6. In the case of photothermographic materials that contain photosensitive silver halide with a reducing agent and a base-release agent, the photothermographic element can have a pH which is about neutral under ambient conditions and which is above about 9 at processing temperatures when the base is released from the base-release agent. Selection and adjustment of the pH of the photothermographic element will depend upon such factors as the particular photosensitive component, other processing agents present and the like.

In some photothermographic elements according to the invention it is desirable to have a stabilizer or stabilizer precursor in the photothermographic material to provide improved post-processing image stability. For instance, in the case of photosensitive silver halide, it can be desirable to stabilize the silver halide after processing in order to avoid post-processing printup. A variety of stabilizers and stabilizer precursors is useful in a photothermographic element as described. The stabilizers and stabilizer precursors can be useful alone or in combination. Typically useful stabilizers and stabilizer precursors are sulfur compounds that form a stable silver mercaptide after image development with the photosensitive silver material at processing temperatures. Photolytically activated polyhalogenated organic compounds can also be useful in some photothermographic materials according to the invention. Selection of an optimum stabilizer or stabilizer precursor will depend upon such factors as the particular photosensitive component, the processing conditions, desired image and the like.

It is useful in some cases to have an overcoat layer on the photothermographic element according to the invention. Such an overcoat layer can help reduce fingerprinting and abrasion marks as well as produce other advantages. The overcoat layer can be one or more of the described polymers which are also useful as binders and separation layer components. It is necessary that the overcoat materials be compatible with the other components of the photothermographic material and tolerate the processing temperatures for the photothermographic elements. Combinations of polymeric materials can be useful for the overcoat layer if desired.

The photothermographic elements according to the invention can comprise a variety of supports which can tolerate the processing temperatures described. Typical supports include poly(ethylene terephthalate) film, cellulose ester film, poly(vinyl acetal) film, polycarbonate film and polyester film supports. Related film and resinous support materials, as well as glass, paper, metal and the like supports which can withstand the processing temperatures described are also useful. Typically, a flexible support is most useful.

The components of the layers of the photothermographic element according to the invention can be coated on a suitable support by various coating procedures known in the photographic art including dip coating, airknife coating, curtain coating or extrusion coating using hoppers. If desired, two or more layers can be coated simultaneously.

It is necessary that the photosensitive component and other components of the photothermographic element be in a location with respect to each other that enables formation of the desired image at processing temperatures. In this respect the photosensitive component must be "in reactive association" with other components of the photothermographic element to produce the desired image. The term "in reactive association" as employed herein is intended to mean that the photosensitive component, such as the photosensitive silver halide, and the image-forming combination such as the reducing agent and the organic silver salt oxidizing agent, are in a location with respect to each other which enables the desired processing and provides a more useful developed image.

If desired, different photothermographic materials can be used in combination in the described photothermographic elements according to the invention. The described separation polymer can enable the use of different photothermographic materials that otherwise might not be compatible with each other. For example, a photothermographic element according to the invention can contain a layer comprising photosensitive silver halide and the processing components necessary to produce a developed silver image, and, in a separate layer, comprise a photosensitive diazotype material with a polysulfonamide layer separating the two different photothermographic materials. Another example of such a photothermographic material is one containing a layer comprising a complex of silver with a nitrogen acid and photosensitive silver halide with a separate layer containing photosensitive silver halide in reactive association with a silver salt of certain heterocyclic thione compounds and the organic reducing agent necessary to produce a developed silver image in the photothermographic element. Selection of an optimum combination of photothermographic materials will depend upon the desired image, processing conditions, particular photosensitive components and the like.

In some photothermographic elements according to the invention it is advantageous to include a heat-sensitive base-release agent, also known as a base precursor, to provide more effective image development. A base-release agent as used herein is intended to include compounds which upon heating in the photothermographic material produce a more effective reaction between the photosensitive component, especially the photosensitive silver halide, and the imageforming combination. Examples of useful heat-sensitive base-release agents are aminimide base-release agents, such as described in *Research Disclosure*, Volume 157, May 1977, Items 15733, 15732, 15776 and 15734; guanidinium compounds, such as guanidinium trichloroacetate; certain amides such as N,N-diethyl-1-imidazole carbonamide; and, other compounds which are known to release a base moiety but do not adversely affect the described photosensitive components, such as photosensitive silver halide.

The heat-sensitive base-release agent can be used in a range of concentrations in the described certain photothermographic materials. The optimum concentration of heat-sensitive base-release agent will depend upon such factors as the desired image, particular reducing agent, particular photosensitive component, processing conditions, particular binder and the like. A useful concentration of described base-release agent is typically within the range of about 0.25 to 2.5 mole of base-release agent per mole of photosensitive component in the photothermographic material.

A variety of diazotype materials can be useful as the photosensitive component in a photothermographic element according to the invention. Typical illustrative diazotype materials which are useful in the described photothermographic elements include p-diazo diphenylamine sulfate, p-diazo diethylaniline zinc chloride, p-diazo ethyl hydroxyethylaniline zinc chloride, p-diazo ethyl methyl aniline zinc chloride, p-diazo diethyl methyl aniline zinc chloride, p-diazo ethyl hydroxyethylaniline zinc chloride, 1-diazo-2-oxynaphthalene-4-sulfonate, p-diethylaminobenzenediazonium chloride $ZnCl_2$4-benzoylamino-2,5-diethoxybenzene diazonium chloride, the p-chlorobenzene-sulfonate of 4-diazo-1-cyclohexylaniline, the p-chlorobenzene-sulfonate of 4-diazo-2-methoxy-1-cyclo-hexylaminobenzene, the tin chloride double salt of 4-N-methylcyclohexylaminobenzene diazonium chloride, p-acetaminobenzene diazonium chloride, 4-dimethylaminobenzene diazonium chloride, 3-methyl-4-diethylaminobenzene diazonium chloride, 4-morpholinobenzene diazonium chloride, 4-piperidyl-2,5-diethoxybenzene diazonium chloride, 1-dimethylaminonaphthalene-4-diazonium chloride and 4-phenylaminodiazobenzene diazonium chloride.

Another embodiment of the invention is a heat developable diazotype photosensitive element comprising (A) at least one diazotype photosensitive layer, (B) at least one layer comprising a processing agent for the diazotype photosensitive layer and (C) a separation layer comprising a polysulfonamide between (A) and (B). An example of a heat processable diazotype photographic element within this embodiment is a heat processable diazotype photographic element comprising, in sequence, (a) a support having thereon (b) a first layer comprising a base-release agent which has the property of releasing base upon heating, (c) a second layer comprising a polymer that is permeable to the base from the base-release agent, (d) a third layer comprising a polysulfonamide polymer that has the property of controlling diffusion of the base from the base-release agent, (e) a fourth layer comprising a polymer that is permeable to the base from the base-release agent, and (f) a fifth layer comprising a diazotype image-forming composition that has the property of being activated by the base from the base-release agent. After imagewise exposure a diazo image can be produced in the element by heating the element to moderately elevated temperatures, such as a temperature within the range of about 100° C. to about 130° C.

A variety of imagewise exposure means can be useful with the photothermographic materials according to the invention. The photosensitive silver halide containing materials and the diazotype materials are typically sensitive to the ultraviolet and blue regions of the spectrum. Exposure means which provide this radiation are preferred. If a spectral sensitizing dye is present in the photosensitive silver halide material, exposure means using other ranges of the spectrum are applicable. Typically, a photothermographic element according to the invention is exposed imagewise with a visible light source, such as a tungsten lamp, although other sources of radiation are useful. Such other sources of radiation include, for instance, lasers, electron beams, X-ray sources and the like. The photothermographic materials are typically exposed imagewise to produce a developable latent image.

A visible image can be produced in a photothermographic material, as described, within a short time after imagewise exposure, by uniformly heating the photothermographic material to moderately elevated temperatures. For example, the photothermographic material can be heated after imagewise exposure to a temperature within the range of about 125° C. to about 200° C. until a developed image is produced. The photothermographic material is heated until a desired image is developed, typically for about 5 to about 60 seconds. The optimum temperature and time of heating can be determined based upon such factors as the desired image, particular photothermographic material, heating means and the like.

Another embodiment of the invention is a process of producing a developed image in an exposed photothermographic element, as defined, comprising heating the element to a temperature within the range of about 125° C. to about 200° C. until the image is developed.

The photothermographic materials according to the invention are useful for forming a negative or positive image. The formation of a negative or positive image will depend primarily upon the selection of the particular photosensitive component, such as the particular photosensitive silver halide. One class of useful photosensitive silver halide materials is the class of direct-positive photographic silver halide materials designed to produce positive images.

Processing of a photothermographic element is typically carried out under ambient conditions of pressure and humidity. Pressures and humidity outside normal atmospheric conditions can be useful if desired; however, normal atmospheric conditions are preferred.

A variety of heating means can be useful to produce the necessary heating of the described exposed photothermographic material to produce a developed image. The heating means can be a simple hot plate, iron, roller, microwave heating means, or the like.

The following examples are included for a further understanding of the invention.

EXAMPLE 1

Formation of dye enhanced silver image

This example demonstrates a photothermographic element according to the invention containing a diffusible silver halide developing agent and a diffusible dye-forming coupler in a polysulfonamide diffusion control layer.

The photothermographic element contained the following layer arrangement:

| | |
|---|---|
| Layer III | Overcoat |
| Layer II | Binder + Photosensitive Silver Halide + Organic Silver Salt Oxidizing Agent |
| Layer I | Polysulfonamide + Coupler + Reducing Agent Support |

Preparation of Layer I

A solution was prepared containing 1.00 grams of the polysulfonamide, poly(ethylene-co-1,4-cyclohexyldimethylene-toluene-2,4-disulfonamide), 9.00 grams of 2-methoxyethanol, 0.225 grams of 2-trifluoroacetamidoresorcinol (dye-forming coupler) and 0.540 grams of 2-methoxy-4-amino-5-methyl-N,N-dimethylaniline sulfuric acid salt monohydrate (reducing agent). The components were mixed and stirred at 90° C. to produce a solution. The resulting clear solution was coated on a poly(ethylene terephthalate) film support at a 5 mil wet coating thickness by means of a doctor blade. The resulting coating was dried by warming the coating to moderately elevated temperatures for 5 minutes (22° C.) and then to 54° C. for 30 minutes.

Preparation of Layer II

Layer II of the photothermographic element was prepared by first preparing a photosensitive silver halide, silver complex suspension. This suspension was prepared by dissolving 12.36 grams of 3-amino-5-benzylthio-1,2,4-triazole (referred to herein as ABT) in 60 ml of ethanol. The clear ethanol solution was diluted by adding 130 ml of ethanol as well as 150 ml of water in which 8.0 grams of deionized gelatin had been previously dissolved. The resulting solution was heated to 110° F. (43° C.) while rapidly agitating in a mechanical blender. A solution of 6.80 grams of silver nitrate dissolved in 60 ml of water was then added to the solution containing ABT. The silver salt suspension formed was further diluted with water sufficient to produce 400 grams of total suspension. An 8.0 ml aliquot of the silver salt suspension containing the silver salt of ABT was combined with 0.3 ml of Surfactant 10G (a trademark, a polyglycidol ether available from the Olin Corporation, U.S.A.), 1.0 ml of a silver halide photosensitive emulsion containing 0.095 grams of photosensitive silver halide (photosensitive silver bromoiodide) in the form of 0.24 micron size crystals. The combined components were well mixed. The resulting suspension was coated at a 5 mil wet coating thickness as Layer II over described Layer I. The composite coating of Layers I and II was dried by heating to moderately elevated temperatures (30° C.) for 5 minutes and then to 50° C. for 3 minutes in a stream of rapidly moving air.

Preparation of Layer III

Layer III of the photothermographic element was prepared as follows: A solution was prepared by dissolving 0.8 grams of a styrene-butadiene copolymer (a commercial product of Phillips Petroleum Company, U.S.A., known under the trade name KRO-3), in 7.2 grams of toluene. The solution was produced by stirring at room temperature (about 20° C.). The toluene containing composition was coated over described Layer II to provide a protective overcoat layer. The resulting three-layer composite was dried by heating the element to moderately elevated temperatures (30° C.) for 5 minutes and then to 50° C. for 30 minutes.

Samples of the resulting photothermographic film were stored at 50% relative humidity and 73° C. (100° F.) for various lengths of time. The samples of film were then removed after storage and exposed sensitometrically using a commercial sensitometer to provide developable latent images in the photothermographic film. (Exposed in a commercial E. G. G. Sensitometer for $10^{-3}$ seconds). The imagewise exposed samples were then heated uniformly by contacting them with a metal block at 150° C. for 15 seconds to produce a developed image in each sample. The maximum image density and minimum image density for each sample were measured using visible light. The maximum and minimum densities for each sample are given in following Table I.

TABLE I

| Storage Time in Days | D-max | D-min |
|---|---|---|
| 0 | 1.65 | 0.28 |
| 3 | 1.45 | 0.22 |
| 9 | 1.52 | 0.22 |
| 15 | 1.65 | 0.22 |

The data in Table I illustrates that the ability to form high maximum density and low minimum density images is preserved during storage. This is in contrast to similar photothermographic films in which the described dye-forming coupler and the reducing agent were incorporated into described Layer II with the photosensitive silver halide and silver complex. In such comparative photothermographic films, the maximum density was reduced to about 1.0 and the minimum density increased to 0.8 during the described storage conditions.

EXAMPLE 2

Photothermographic diazotype element

A photothermographic element was prepared having the following layer arrangement:

| | |
|---|---|
| Layer V | Diazotype imaging layer |
| Layer IV | Spacer layer |
| Layer III | Diffusion control barrier layer |
| Layer II | Spacer layer |
| Layer I | Base-release agent layer Support |

The Layers I-V were prepared as follows:

Four polymer solutions were prepared as follows:

The coating composition for Layer I was prepared by mixing cellulose acetate (0.957 grams) in 13.0 grams of N,N-dimethylformamide. The resulting composition was stirred at room temperature (about 20° C.). N,N-diethyl-1-imidazole carboxamide (0.493 grams) was dissolved in the cellulose ester solution with gentle stirring. This resulted in a composition suitable for coating as Layer I.

A coating composition for Layer II (also described herein as an antistrike layer) was prepared as follows: 5 grams of polyisobutylene rubber (a commercially available composition known under the trade name of VISTANEX MN-L-140, commercially available from the Exxon Chemical Company, U.S.A.). The polyisobutylene rubber was dissolved in 95 grams of toluene by stirring at room temperature (about 20° C.). This resulted in a suitable coating composition for Layer II.

A coating composition for Layer III was prepared as follows: 3 grams of poly(ethylene-cohexamethylenetoluene-2,4-disulfonamide) in which the ethylene and hexamethylene moieties were present in equal molar proportions was dissolved in 27.0 grams of acetone. A clear solution was formed from the resulting components by stirring at room temperature (about 20° C.).

The composition for Layer II was also used for Layer IV.

Preparation of Layer V was as follows: 10 grams of cellulose acetate butyrate were dissolved in 90.0 grams of acetone by stirring at room temperature (20° C.). A clear solution resulted. To the clear solution was added 0.20 grams of 5-sulfosalicyclic acid, 0.840 grams of paradiazo-N,N-diethylaniline fluoroborate and 0.66 grams of 2-naphthanilide (commercially available from the Fairmount Chemical Co., U.S.A. under the trade name Naphthol ASD). The solids were readily dissolved by stirring the composition.

The photothermographic element was prepared as follows: A 4 mil film support consisting of poly(ethylene terephthalate) was used as the support for the photothermographic element. The composition for Layer I was coated on the film support at a 4 mil wet coating thickness. The resulting coating was dried by heating to 80° F. (27° C.) for 5 minutes and then to 120° F. (49° C.) for an additional 5 minutes in a rapidly moving air stream. The composition for Layer II was then coated at a 2 mil wet coating thickness on Layer I. Layer II was dried at 100° F. (38° C.) for 5 minutes.

Layer III (the diffusion control layer) was coated at a 2 mil coating thickness over Layer II. Layer III was permitted to dry by a short exposure to heat at 100° F. (38° C.). Layer IV (an antistrike layer) was coated over Layer III in the same way that Layer II was coated on Layer I. The diazo photosensitive layer (Layer V) was coated on Layer IV as an overcoat layer. Layer V was coated at a 5 mil wet coating thickness. The composite photothermographic film was dried for 5 minutes at 110° F. (43° C.) in an air stream to produce a photothermographic element according to the invention.

The resulting photothermographic diazotype element was imagewise exposed to visible light through a step tablet. The imagewise exposure was for 12 seconds and produced a developable latent image in the diazotype element. The image was developed by heating the element on an aluminum platen for 4 seconds at 130° C. A developed diazotype image was obtained. The developed image had a maximum density of 1.44 and a minimum density of 0.04.

The rate with which the diazotype image develops without light exposure at various temperatures was measured by heating samples of the heat developable diazotype element and measuring the time required to generate azo dyes sufficient to produce a density of 0.15. The times required at various temperatures are given in the following Table II.

TABLE II

| Temperature of Heating | Seconds Required to Develop D = 0.15 |
|---|---|
| 40° C. | 1,425,000 sec. |
| 90° C. | 390 sec. |
| 110° C. | 27 sec. |
| 130° C. | 4 sec. |

Samples of the photothermographic film were stored at 100° F. (38° C.) and 50% relative humidity for 7 days and produced sensitometric results which were essentially unchanged from the fresh photothermographic film.

EXAMPLE 3

Comparison of development rate for elements containing other polymers

Photothermographic elements were prepared as described in Example 2 except two other polymer layers of equal thickness were substituted for the described diffusion control Layer III containing the polysulfonamide. The time required for the resulting photothermographic element to develop to 0.15 density (i.e. fog density of 0.15 was considered objectionable) at 40° C. were compared as illustrated in the following Table III.

TABLE III

| Diffusion Control Polymer in Layer III | Time Required for Development to D = 0.15 at 40° C. |
|---|---|
| 1. polyisobutylene rubber (VISTANEX MN-L-140, trade name and available from Exxon Chemical Co., U.S.A.) (comparative example) | 7.5 hours |
| 2. poly(ethylene phthalate) (comparative example) | 10.0 hours |
| 3. polysulfonamide (as described in Example 2) (invention) | 400.0 hours |

The data in Table III illustrates the surprising increased storage stability provided by a barrier layer consisting essentially of a polysulfonamide according to the invention.

EXAMPLE 4

Photothermographic diazotype element containing polysulfonamide diffusion control layer and benzimidazole as a base-release agent A photothermographic diazotype element was prepared as described in Example 2 except that the diffusible base in Layer I was replaced with an equal molar amount of benzimidazole. The resulting photothermographic diazotype element was imagewise exposed through a stepwedge as described in Example 2. The resulting developable image was developed by heating the photothermographic element on an aluminum block for 10 seconds at 130° C. The developed image had a maximum density of 1.50 and a minimum density of 0.05. The stability of the photothermographic film at room temperature (about 22° C.) was found to be about 5 million times as slow as the stability demonstrated by the development rate at 130° C. The photothermographic element had desired storage stability.

EXAMPLE 5

Photothermographic silver element containing polysulfonamide diffusion control layer A photothermographic silver halide film was prepared having the following layer arrangement:

| | |
|---|---|
| Layer III | polysulfonamide + fixing agent |
| Layer II | antistrike layer |
| Layer I | photosensitive silver halide + reducing agent + organic silver salt oxidizing agent + binder |

-continued

| |
|---|
| support |

The organic silver salt oxidizing agent in described Layer I above was a silver complex of 3-amino-1,2,4-triazole. This silver complex was prepared as follows: a 1.0 molar solution of 3-amino-1,2,4-triazole (50 ml) and 250 ml of gelatin (20% deionized photographic gelatin in distilled water) were added to 150 ml of distilled water. To this mixture was rapidly added, with stirring, a 1.0 molar solution of silver nitrate (50.0 ml). The resulting dispersion had a pH of 3.5 and a pAg of 4.2. The dispersion contained 1 mole of silver for each 10 kilograms of dispersion.

A coating suspension for Layer I was prepared as follows: 620 ml of the described silver complex dispersion was mixed with 0.06 moles of a silver bromoiodide emulsion (silver bromoiodide in gelatin) in 46.4 ml of water, 4.0 grams of surfactant (Surfactant 10G which is a polyglycidol ether available from the Olin Corporation, U.S.A., and is a trade name), and 329.6 ml of distilled water. The coating suspension was combined with 10.40 gm of a reducing agent (2,5-dihydroxyphenylacetic acid) dissolved in water. The resulting composition was coated on a poly(ethylene terephthalate) film support as Layer I at a thickness to provide 141 mg of silver/ft$^2$ (equivalent to 1,523 mg of silver/m$^2$), and 113 mg developer/ft$^2$. The coating was dried by exposure to warm air to produce Layer I.

Layer II was produced as follows: 1 gram of polyisobutylene (VISTANEX MN-L-140 available from the Exxon Chemical Company, U.S.A. and a trade name) was dissolved in 19 grams of hexane with 1.0 grams of mineral oil. A clear solution resulted upon stirring the composition at room temperature (22° C.). The resulting polymer solution was coated as Layer II over Layer I at a 2 mil wet coating thickness. The composite coating of Layers II and I was dried at 75° C. for 5 minutes.

Layer III was prepared as follows: 3 grams of poly(ethylene-co-1,4-cyclohexylenedimethylene-1-methyl-2,4-benzenedisulfonamide) and 1.8 grams of 1-methyl-4-imidazoline-2-thione (referred to herein as MIT) were dissolved in 22.0 grams of methoxyethanol by stirring at room temperature. A clear coating solution resulted. Layer III was coated over Layer II at a 4 mil wet coating thickness. The composite of layers was dried for 5 minutes at 150° F. (66° C.).

The resulting photothermographic film was imagewise exposed sensitometrically (using a commercial E.G.G. Sensitometer) through a stepwedge to produce a developable latent image in the photothermographic film. The exposed photothermographic film was heated on an aluminum block for 30 seconds at 110° C. to develop the latent image. A silver image was produced having a maximum density of 1.54 and a minimum density of 0.10. The resulting photothermographic film was then exposed overall to a tungsten light source (220 foot candles for 1 minute) and then reheated to 110° C. for 90 seconds. The minimum density areas of the photothermographic film showed no development and had a density of 0.10 after the second exposure and reheating. This demonstrates that the image developed in the photothermographic film was stabilized as desired.

EXAMPLE 6

Photothermographic silver halide element containing polysulfonamide diffusion control layer and poly(acrylamide) antistrike layer A photothermographic element was prepared as described in Example 5 except that a poly(acrylamide) antistrike layer was coated between the diffusion control layer and the photosensitive silver halide layer. The poly(acrylamide) antistrike layer was prepared as follows: 2.08 grams of poly(acrylamide) (commercially available as Polyacrylamide 250 from American Cyanamide Corporation, U.S.A.) and 0.20 grams of surfactant (Surfactant 10G) were dissolved in 16.72 grams of distilled water. A clear solution resulted by stirring at room temperature (22° C.). The resulting solution was coated over the photosensitive silver halide layer at a 6 mil wet coating thickness. The composite of the photosensitive silver halide layer and the poly(acrylamide) layer was dried for 5 minutes at 150° F. (66° C.). The described Layer III (diffusion control layer) was coated on the poly(acrylamide) layer and the resulting composite described as in Example 4.

The resulting photothermographic film was imagewise exposed through a carbon stepwedge sensitometrically to produce a developable latent image in the photothermographic film. The photothermographic film was then heated at 110° C. for 10 seconds to develop the latent image. The developed image had a maximum density of 1.27 and a minimum density of 0.09. The photothermographic film was then reexposed to tungsten light (220 foot candles for 1 minute) and then reheated for 90 seconds at 110° C. The minimum density areas of the photothermographic film increased slightly from 0.09 to 0.13. This indicated that the image developed in the photothermographic element was stabilized as desired.

EXAMPLE 7

Photothermographic element for producing a dye enhanced silver image

A photothermographic element was prepared having the following layer arrangement:

| | |
|---|---|
| Layer III | polysulfonamide + fixing agent |
| Layer II | antistrike layer |
| Layer I | photosensitive silver halide + coupler + reducing agent + organic silver salt oxidizing agent |
| | support |

A silver complex of 3-amino-5-benzylthio-1,2,4-triazole (ABT) was prepared by dissolving 12.36 grams of ABT in 60 ml of ethanol. The clear ethanol solution was diluted by adding 130 ml of ethanol as well as 150 ml of water in which 8.0 grams of deionized gelatin had been previously dissolved. The resulting solution was heated to 110° F. (43° C.) while rapidly agitating in a mechanical mixing apparatus. A solution of 6.80 grams of silver nitrate dissolved in 60.0 ml of water was then added to the resulting solution. The silver salt suspension formed was further diluted with water sufficient to produce 400 grams of total suspension. An 8.0 ml aliquot of the silver salt suspension was combined with 0.3 ml of surfactant (Surfactant 10G), 1.0 ml of a photosensitive silver halide emulsion containing 0.095 grams of silver halide in the form of 0.24 micro size crystals, 0.075 grams of 2-methoxy-4-amino-5-methyl-N,N-dimethylaniline sulfuric acid salt monohydrate (reducing agent) and 0.150 grams of 2-trifluoroacetamido resorcinol (dye-forming coupler). The combined components were well mixed at room temperature (22° C.) and coated on a poly(ethylene terephthalate) film support at a 5 mil wet coating thickness to produce Layer I. The resulting Layer I was dried by warming at 140° F. (60° C.) for 5 minutes and then for 15 minutes at 40° F. (4° C.).

Layer II (antistrike layer) was prepared as follows: Layer I was overcoated with a resin solution prepared by dissolving 0.8 grams of styrene-butadiene copolymer (KRO-3 as described) in 7.2 grams of toluene. The resin solution was coated over the Layer I at a 5 mil wet coating thickness. The resulting composite of Layers I and II was dried for 5 minutes at 140° F. (60° C.) and then 30 minutes at 50° C.

Layer III was prepared as follows: A solution was prepared containing 1.20 grams of poly(ethylene-co-1,4-cyclohexylenedimethylene-toluene-2,4-disulfonamide), 10.0 grams of 2-methoxyethanol and 0.180 grams of 1-methyl-4-imidazoline-2-thione. The resulting mixture was stirred at room temperature 22° C. until a clear solution was obtained. A resulting composition was coated on Layer II at a 5 mil wet coating thickness. The resulting three-layer composite was dried by heating to 140° F. (60° C.) for 5 minutes and then 50° C. for 30 minutes in a rapidly moving air stream.

The resulting photothermographic element was imagewise exposed through a stepwedge in a commercial sensitometer to provide a developable latent image in the photothermographic element. Samples of the exposed photothermographic element were heated for various lengths of time varying from 0 to 60 seconds on an aluminum block at 155° C. The maximum density and minimum density of the developed image was measured in each instance. This measurement was made with visible light. The resulting photothermographic film samples were then totally exposed to a tungsten lamp (220 foot candles for 1 minute) and then reheated for 15 seconds at 155° C. Several of the samples were totally exposed to room light at 110 foot candles for 6 months and then reheated to 155° C. for 15 seconds. The density of the minimum density areas of the totally exposed photothermographic film was again measured to determine the potential for image forming ability remaining in the film. These results are given in following Table IV.

TABLE IV

| | | Dmin | | |
|---|---|---|---|---|
| Heat Processing (Seconds at 155° C.) | Dmax | Original | Reexpose and Heat | 6 months Reexpose and Heat |
| 15 | 0.99 | 0.21 | 0.34 | 0.34 |
| 20 | 1.07 | 0.21 | 0.30 | 0.30 |
| 30 | 1.25 | 0.25 | 0.31 | 0.31 |

Comparison of the minimum density values obtained and shown in Table IV illustrate that the minimum density areas increase slightly on exposure and reprocessing and that the film is thereafter essentially stabilized to further increases in density in the minimum density areas.

The invention has been described in detail with particular reference to preferred embodiments thereof, but it will be understood that variations and modifications can be effected within the spirit and scope of the invention.

What is claimed is:

1. In a photothermographic element comprising (A) at least one photosensitive layer comprising a diazo or silver halide photosensitive component, (B) at least one layer comprising a processing agent for said photosensitive component and (C) a separation polymer between said photosensitive component and said processing agent, the improvement wherein said separation polymer (C) comprises a polysulfonamide which has the property of producing increased preexposure storage stability for said element.

2. A photothermographic element as in claim 1 wherein said polysulfonamide is a compound represented by the structure:

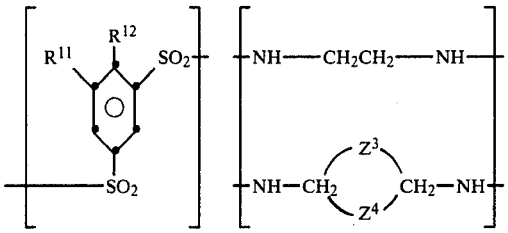

wherein $R^{11}$ and $R^{12}$ are individually alkyl containing 1 to 3 carbon atoms or halogen; and, $Z^3$ and $Z^4$ represent the carbon atoms necessary to complete a carbocyclic ring.

3. A photothermographic element as in claim 1 wherein said polysulfonamide consists essentially of poly(ethylene-co-1,4-cyclohexyldimethylene-toluene-2,4-disulfonamide).

4. In a photothermographic element having increased preexposure storage stability, said element comprising (A) a layer comprising, (a) in a binder, (b) a dye-forming coupler and (c) a reducing agent which in its oxidized form reacts with said coupler to produce a dye, and (B) a layer comprising, (d) in a binder, (e) photosensitive silver halide and (f) an organic silver salt oxidizing agent which, with said reducing agent, is an oxidation-reduction image-forming combination, and (C) an overcoat layer, the improvement wherein said binder in (A) comprises a polysulfonamide which has the property of producing increased preexposure storage stability for said element.

5. A photothermographic element as in claim 4 wherein said polysulfonamide consists essentially of poly(ethylene-co-1,4-cyclohexyldimethylene-toluene-2,4-disulfonamide).

6. A photothermographic element as in claim 4 wherein said overcoat layer consists essentially of a styrene-butadiene copolymer.

7. In a photothermographic element comprising a support having thereon (A) a first layer comprising (a) photosensitive silver halide in reactive association with (b) an organic silver salt oxidizing agent, in (c) a gelatino binder, and (B) contiguous to (A), a second layer comprising (d) a diffusible, organic reducing agent for said organic silver salt, (e) a diffusible, dye-forming coupler that forms a dye with the oxidized form of the reducing agent in (f) a polymeric binder, the improvement wherein said polymeric binder in (B) comprises a polysulfonamide that has the properties of being permeable to said reducing agent and producing increased preexposure storage stability for said element.

8. A photothermographic element comprising a support having thereon, in sequence, (A) a first layer comprising (a) a polysulfonamide binder, and (b) a silver halide stabilizing concentration of a heterocyclic thione silver halide stabilizing agent, and, contiguous to (A), (B) a second layer consisting essentially of (c) a polymeric antistrike composition, and, contiguous to (B), (C) a third layer comprising (d) photosensitive silver halide, in reactive association, with (e) an oxidation-reduction image-forming combination comprising (i) a silver salt of a long-chain fatty acid, with (ii) a reducing agent, in (f) a poly(vinyl butyral) binder.

9. A photothermographic element comprising a support having thereon, in sequence, (A) a first layer comprising (a) a polysulfonamide binder consisting essentially of poly(ethylene-co-1,4-cyclohexylenedimethylene-1-methyl-2,4-benzenedisulfonamide), (b) a stabilizing concentration of 1-methyl-4-imidazoline-2-thione, and, contiguous to (A), (B) a second layer consisting essentially of (c) a polyisobutylene antistrike composition, and, contiguous to (B), (C) a third layer comprising (d) photosensitive silver halide, in reactive association, with (e) an image-forming combination comprising (i) an organic silver salt oxidizing agent consisting essentially of a 3-amino-1,2,4-triazole silver salt, with (ii) an organic reducing agent consisting essentially of 2,5-dihydroxyphenylacetic acid, in (f) a gelatino binder.

10. A photothermographic element comprising a support having thereon, in sequence, (A) a first layer comprising (a) a polysulfonamide binder, and (b) a stabilizing concentration of a heterocyclic thione silver halide stabilizing agent, and, contiguous to (A), (B) a second layer consisting essentially of (c) a polymeric binder, antistrike composition, and, contiguous to (B), (C) a third layer comprising (d) photosensitive silver halide, in reactive association, with (e) an image-forming combination comprising (i) an organic silver salt oxidizing agent consisting essentially of an organic nitrogen acid silver salt, with (ii) a reducing agent, in (f) a gelatino binder.

11. A photothermographic element comprising a support having thereon, in sequence, (A) a first layer comprising (a) photosensitive silver halide, in reactive association, with (b) an organic silver salt oxidizing agent consisting essentially of a 3-amino-5-benzylthio-1,2,4-triazole silver salt, in (c) a gelatino binder, and, contiguous to (A), (B) a second layer comprising (d) a diffusible organic reducing agent consisting essentially of 2-methoxy-4-amino-5-methyl-N,N-dimethylaniline sulfuric acid salt monohydrate, with (e) a diffusible dye-forming coupler consisting essentially of 2-trifluoroacetamidoresorcinol, in (f) a polymeric binder consisting essentially of poly(ethylene-co-1,4-cyclohexyldimethylene-toluene-2,4-disulfonamide).

12. In a heat developable diazotype photosensitive element comprising (A) at least one diazotype photosensitive layer, (B) at least one layer comprising a processing agent for said diazotype photosensitive layer and (C) a separation layer between (A) and (B), the improvement wherein said separation layer (C) comprises a polysulfonamide which has the property of producing increased preexposure storage stability for said element.

13. In a heat processable diazotype photographic element comprising, in sequence, (a) a support, having thereon (b) a first layer comprising a base-release agent which has the property of releasing base upon heating, (c) a second layer comprising a polymer that is permeable to the base from said base-release agent, (d) a third layer comprising a polysulfonamide polymer that has the property of controlling diffusion of the base from said base-release agent, (e) a fourth layer comprising a polymer that is permeable to the base from said base-release agent, and (f) a fifth layer comprising a diazotype imageforming composition that has the property of being activated by the base from said base-releasing agent.

14. A process of producing a developed image in an exposed photothermographic element as defined in claim 1 comprising heating said element to a temperature within the range of about 125° C. to about 200° C. until said image is developed.

15. A process of producing a diazo image in an exposed heat developable diazotype photosensitive element as defined in claim 12 comprising heating said element to a temperature within the range of about 100° C. to about 150° C. until said image is developed.

16. A method of providing increased preexposure stability to a photothermographic element of the type having at least one photosensitive layer comprising a diazo or silver halide photosensitive component, (B) at least one layer comprising a processing agent for said photosensitive component and (C) a separation polymer between said photosensitive component and said processing agent, comprising incorporating a polysulfonamide separation polymer into said photothermographic element between said photosensitive component and said processing agent.

17. A method of providing increased preexposure stability in a photothermographic element of the type having at least one diazo or silver halide photosensitive layer and at least one layer comprising a processing agent for the photosensitive layer, comprising incorporating a polysulfonamide containing layer between the photosensitive layer and the processing agent layer.

18. A method as in claim 17 wherein said polysulfonamide containing layer comprises poly(ethylene-co-1,4-cyclohexyldimethylene-toluene-2,4-disulfonamide).

* * * * *